United States Patent [19]

Russell

[11] Patent Number: 4,766,998

[45] Date of Patent: Aug. 30, 1988

[54] STORAGE AND DISPLAY STRUCTURE

[76] Inventor: Ronald E. Russell, R.R. #2, Box 189, Sand Pond Rd., West Buxton, Me. 04093

[21] Appl. No.: 87,208

[22] Filed: Aug. 20, 1987

[51] Int. Cl.[4] ..... B65D 5/50; B65D 55/00

[52] U.S. Cl. ..... 206/45; 206/45.11; 206/45.16

[58] Field of Search ..... 206/45.11, 45.16, 44.11, 206/44.12, 45

[56] References Cited

U.S. PATENT DOCUMENTS

| | | | |
|---|---|---|---|
| 1,616,980 | 2/1927 | MacDougall | 206/45.16 |
| 1,680,539 | 8/1928 | Aadi | 206/45.16 |
| 1,987,519 | 1/1935 | Seminara | 206/45.16 |
| 2,369,335 | 2/1945 | Burman | 206/45.16 |
| 2,646,875 | 7/1953 | Feder | 206/45.16 |
| 3,190,438 | 6/1965 | Cain et al. | 206/45.16 |
| 3,977,494 | 8/1976 | Ulin | 206/45.16 |
| 4,485,919 | 12/1984 | Sandel | 206/523 |

FOREIGN PATENT DOCUMENTS

| | | | |
|---|---|---|---|
| 17515 | 12/1928 | Australia | 206/45.16 |

*Primary Examiner*—Joseph Man-Fu Moy
*Attorney, Agent, or Firm*—William Nitkin

[57] ABSTRACT

A display case or storage device having a plurality of depressor elements arrayed with each of their tops forming a planar surface of a particular shape, each depressor element being depressable and retainable at a lower level to form a cavity for receipt of an object if desired, such depressor element also being releasable from its depressed mode to rise to its original height.

6 Claims, 8 Drawing Sheets

STORAGE AND DISPLAY STRUCTURE

BACKGROUND OF THE INVENTION

1. Field of the Invention

The device of this invention is container and more particularly relates to a storage and/or display structure with a plurality of selectively depressor elements, each of which can alternately be releasably depressed and retained at a lower level until released to rise to its original level. When one or more depressor elements are in their depressed state, they form indented areas for the receipt of objects for storage or display and the like.

2. Description of the Prior Art

The prior art for storage and display of materials is in the area of shelving and display cabinets and also relates to the area of drawers and carrying cases such as suitcases, parts storage carrying cases and other container elements which are well known in the art to hold one or more objects.

SUMMARY OF THE INVENTION

It is an object of this invention to provide a new, heretofore unknown, form of storage and display apparatus which can be utilized on walls as a display shelf, can be utilized in drawers to hold various items, and can even be utilized as part of a storage and/or carrying case.

It is a further object of this invention to provide a structure having depressor elements along a generally planar surface to form areas in which storage and display of an item can occur for objects placed in such areas formed when such depressor elements are in their depressed mode, forming a single or a plurality of single or multiple-leveled areas which can be used for storage or display of items.

It is a further object of this invention to provide such depressor elements in a plurality of shapes such as cubical, triangular, hexagonal or other shape in a variety of dimensions and that they can be depressed and retained in a variety of positions in relation to the planar surface of the original height of the non-depressed elements.

It is yet a further object of this invention that the storage and display structure of this invention be made of a wide variety of materials ranging from plastic to wood and that the structure of this invention be useful in industry, in business offices, the home environment and all places where such a storage or display structure is needed.

The structure of this invention is a container comprised of a plurality of depressor elements arrayed within a container, the tops of which depressor elements form a planar surface in their non-depressed mode. Each of the depressor elements is individually depressable and retainable at various depths below the original height of the planar surface formed by the tops of any remaining non-depressed depressor elements. When depressed singly or as a group to various depths, the depressed depressor elements form a series of storage or display compartments. The array of depressor elements within the container can be utilized in cases, drawers or even suspended upright on a wall for use as a display cabinet wherein the objects to be held are contained within the cavities formed when the depressor elements are in their depressed mode. The depressor elements can be formed in a variety of configurations, for example, rectangular, and they move upward and downward within a grid that is supported from the container, the grid having apertures to receive the depressor elements with the grid itself adapted to be received in slots defined within each depressor element. When the depressor elements are depressed or raised, they have members which interact with the grid element, as will be described below, to hold the depressor elements in their lowered position. Each depressor element also includes means to cause the release thereof from its depressed position so it can rise back up to the height of the original planar surface when desired.

DESCRIPTION OF THE PREFERRED EMBODIMENT(S)

Figure 1:
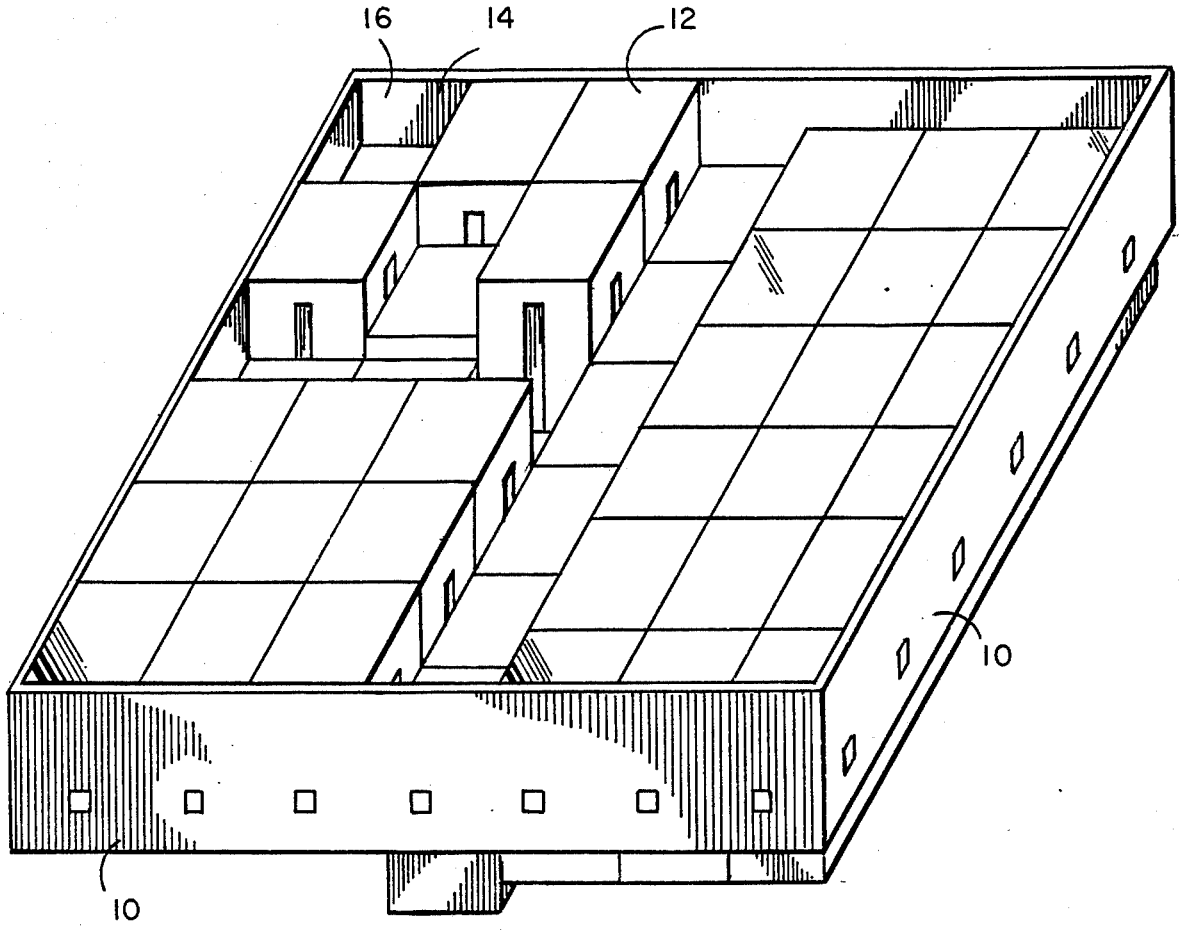
FIG. 1 illustrates the structure of this invention being a container having a plurality of depressor elements, some of which are seen in their depressed mode.

FIG. 1 illustrates container 10 having within it a plurality of depressor elements 12 some of which, such as element 14, are seen in a depressed mode forming cavity 16 in which one or more objects can be positioned. It should be noted that container 10 can be disposed in either a vertical or horizontal mode depending upon the desired usage of the device. Several depressor elements are seen depressed forming further cavities in which objects can be positioned.

Figure 2:
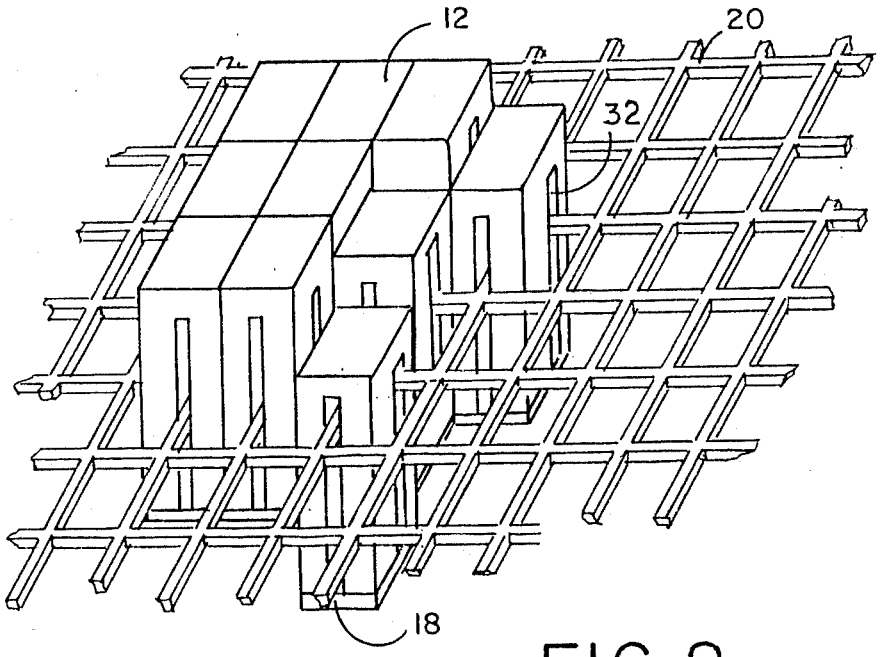
FIG. 2 illustrates a perspective view of a plurality of rectangular depressor elements on the grid.
Figure 3:
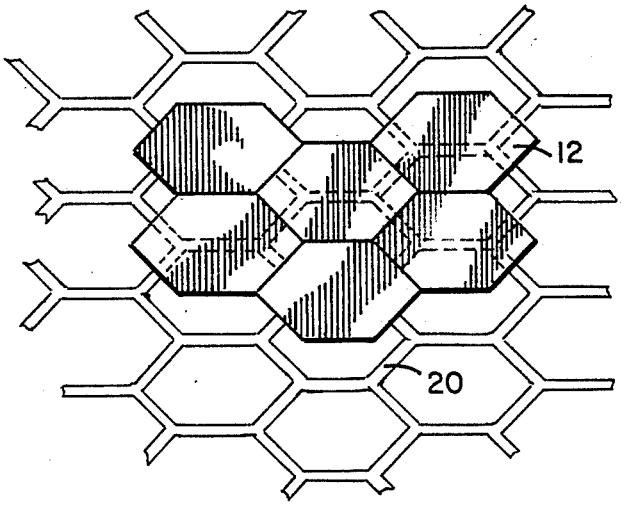
FIG. 3 illustrates a plurality of hexagonal depressor elements on a grid suitable for the support of hexagonal depressor elements.
Figure 4:
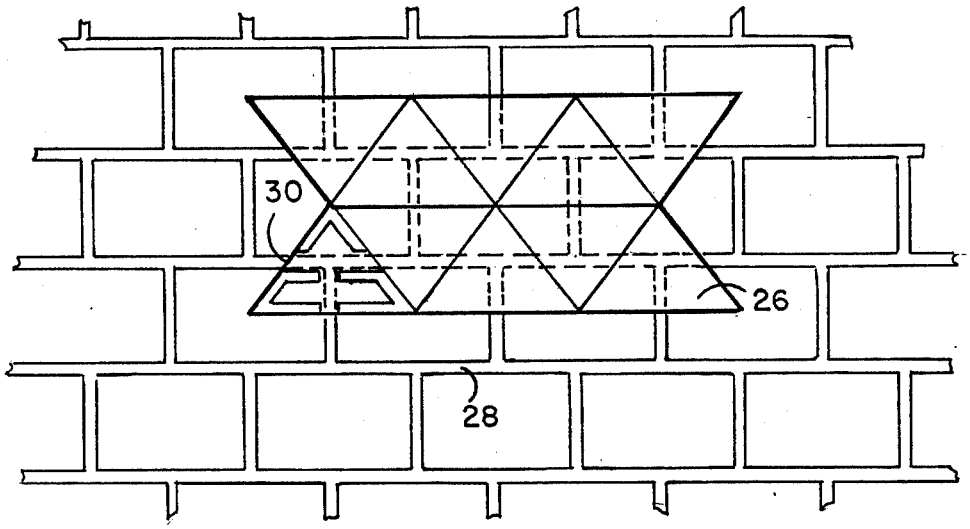
FIG. 4 illustrates a plurality of triangular depressor elements on a grid suitable for the support of triangular depressor elements.
Figure 5:
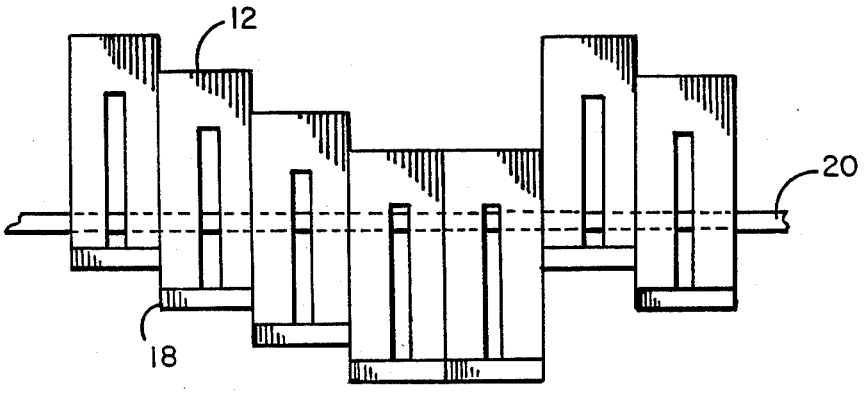
FIG. 5 illustrates a side view of a plurality of depressor elements some of which are in their depressed mode.

FIG. 2 illustrates a perspective sectional view of a smaller number of square depressor elements on a grid having square openings showing depressor elements 12 with a plurality of slots 18 defined therein through which a portion of grid 20 passes in and out of each individual depressor element. The top of each depressor element is square with perpendicular sides thereto extending downward the length of the depressor element. Portions of four square depressor elements are received in each square opening in grid 20. It should be noted that a plurality of different top shapes can be utilized for the depressor elements. For example, FIG. 3 illustrates hexagonal depressor elements 22 on grid 24 having hexagonal openings for receipt of a portion of four such hexagonal elements, and they operate in the same fashion as rectangular depressor elements 12 except that allowances must be made for the shape of the depressor elements where the grid members pass through the sides at different angles from the rectangular depressor elements. In the same vein, FIG. 4 shows depressor elements 26 having a triangular top surface on rectangular opening grid 28 which is configured to receive portions of six triangular depressor elements within slots 30 formed within triangular depressor elements 26. It should be noted that although the balance of this explanation concerns rectangular depressor members, other top shapes can be utilized and still fall within the spirit and scope of this invention.

Figure 6:
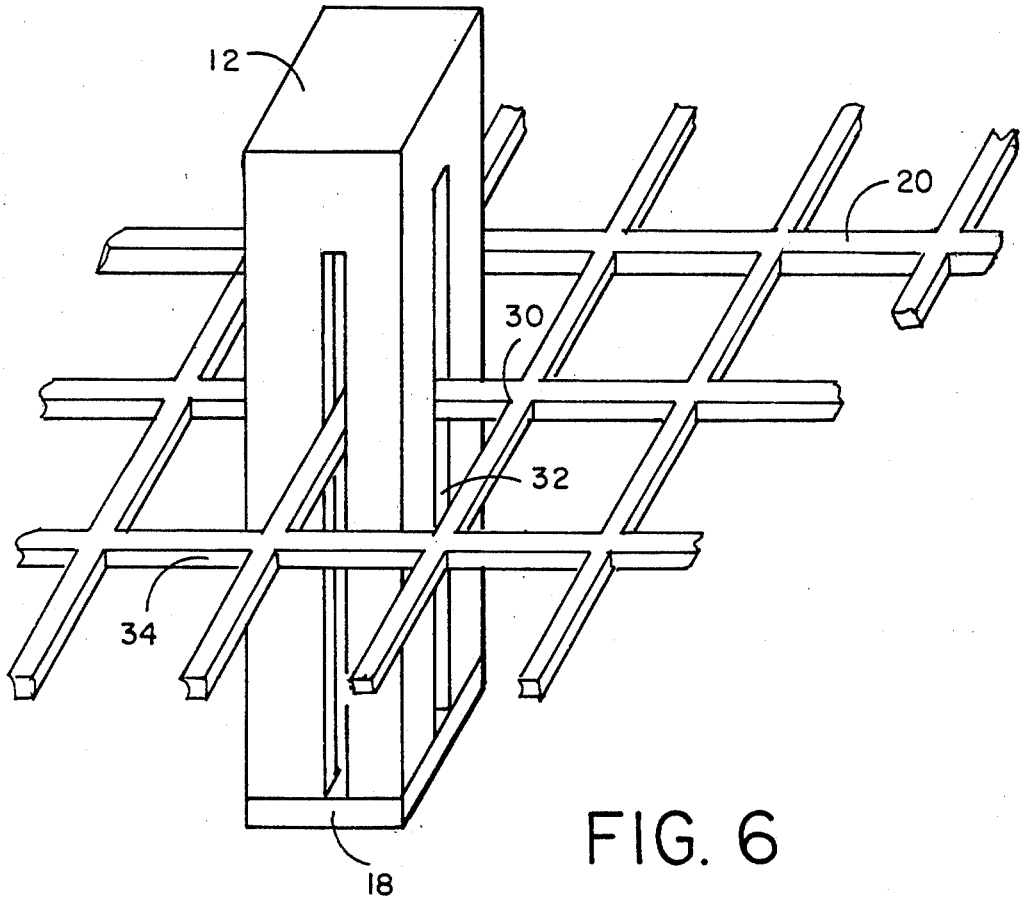
FIG. 6 illustrates a view of a single depressor element within a section of the grid.
Figure 7:
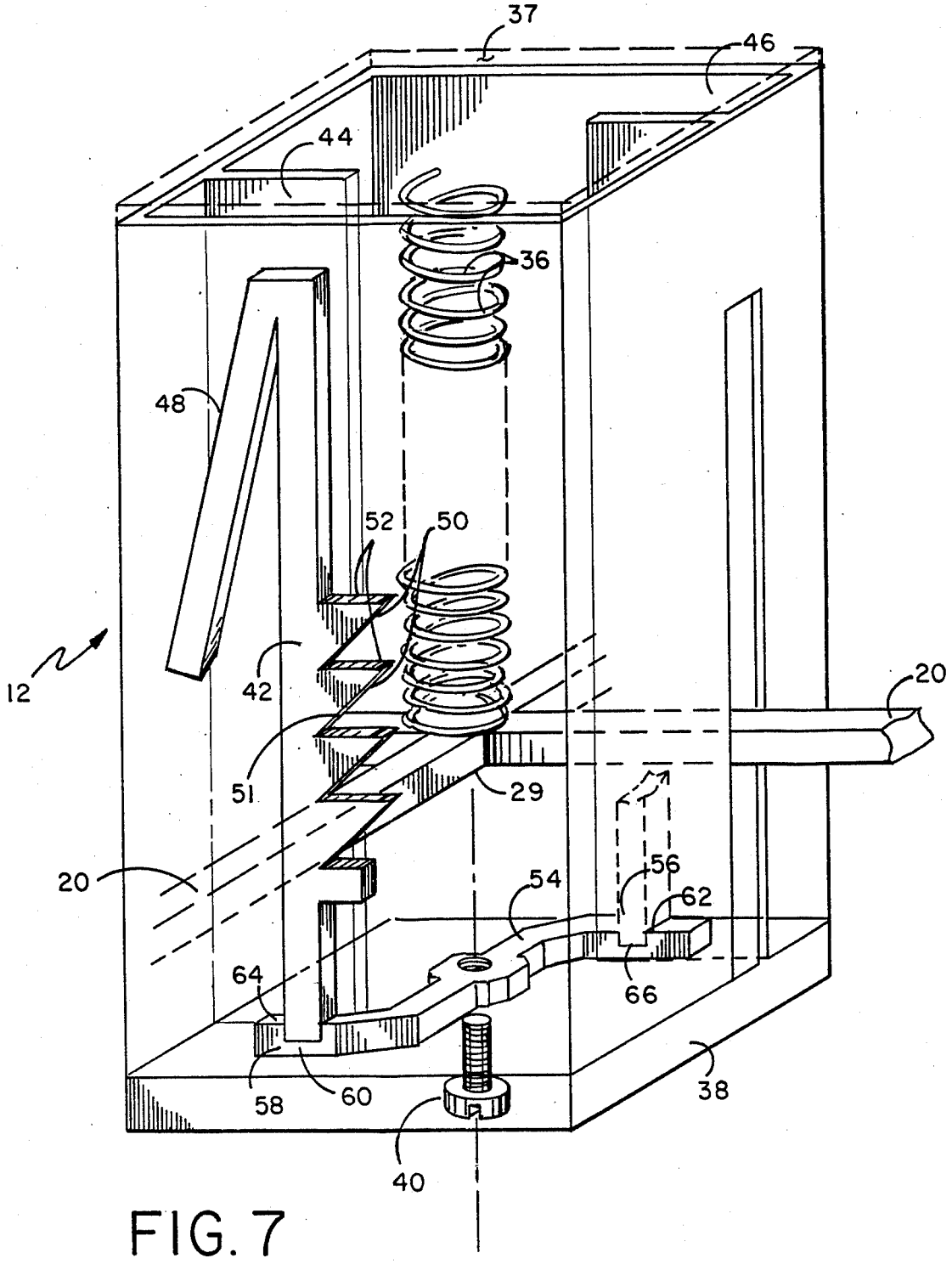
FIG. 7 illustrates a cutaway view of the depressor element of FIG. 6 showing its internal structure.
Figure 10:
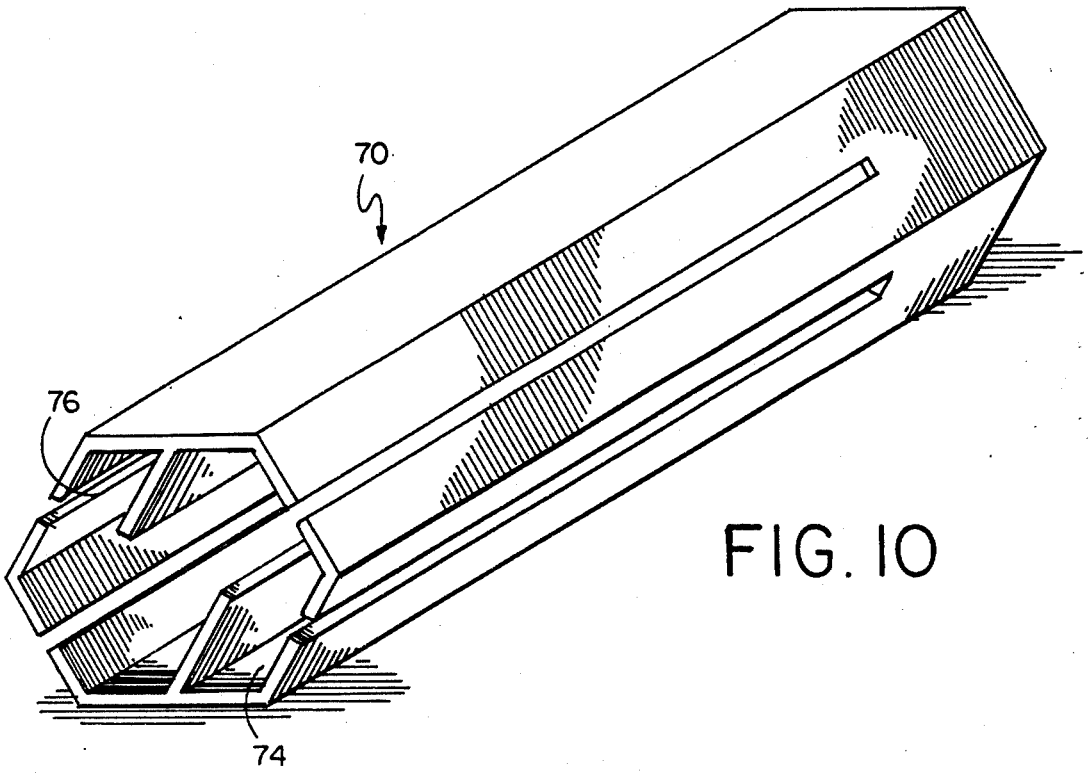
FIG. 10 illustrates a perspective bottom view of a hexagonal depressor elements.
Figure 11:
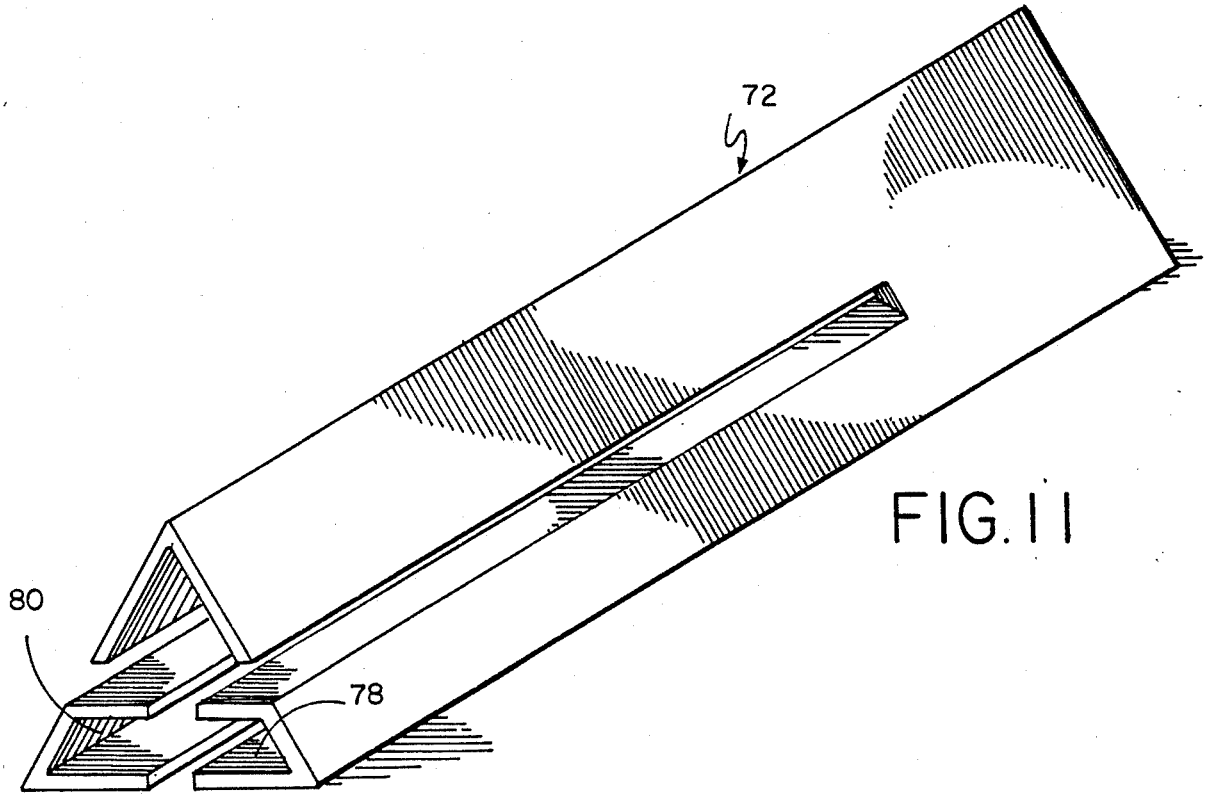
FIG. 11 illustrates a perspective bottom view of a triangular depressor elements.

FIG. 6 illustrates a view of rectangular depressor element 12 on grid 20 with slots 18 allowing depressor element 12 to be moved up and down engaged and interlocked with grid 20. There are spaces on either side of depressor element 12 for further depressor elements to be engaged onto the grid on positions 30, 32 and 34 thereof, each depressor element being independently movable from one another and held thereon in a similar fashion as depressor element 12 is held and engaged to grid 20 as will be described below. Depressor element 12 as seen in FIG. 7 has within it compression spring member 36 which is engaged from inside of the top 37 of depressor element 12 to grid corner 29 and urges the depressor element upwards. Retainer plate 38 is held on the bottom of the depressor element by reset lock screw 40 as will be described in further detail below. A plurality of position retainer clips 42, which in the case of rectangular depressor element 12 are held within slots 44 and 46 are members which have a first arm 48 which urges outward against the insides of depressor element 12 and a plurality of teeth 50 which are angled downward and have horizontal elements 52 at the top thereof which are adapted to engage against the sides of grid elements 20 when arm 48 urges them thereagainst when depressor 12 is depressed. The position retainer clip 42 moves by grid 20 sliding along the angular portions 51 of teeth 50 and are always urged inwards by arm 48 thereby when horizontal portion 52 of tooth 50 is under the bottom horizontal portion of the grid, element 52 engages thereunder. When the position retainer clip 42 is pushed further downward, angular portion 51 of tooth 50 moves the position retainer clip away from the grid until the next horizontal portion 52 of the next tooth 50 engages therewith, thereby compressing spring 36 and holding the depressor element every time it is moved downward at a new position. In order to release the position retainer clips, if one wishes to raise depressor member 12 from its depressed position, reset lock armature 54 is utilized beneath the grid but above retainer plate 38 in which is engaged reset lock screw 40. The reset lock armature has arms 56 and 58 in which slots 60 and 62 are formed into which engages bases 64 and 66 respectively of position retainer clips 42 and when reset lock screw 40 is rotated, the lock screw rotates the reset lock armature 54 causing slots 60 and 62 to move position retainer clips' bases 64 and 66 away from the sides of grid 20 sufficiently so that they no longer have the upper horizontal edge 52 of tooth 50 engaged beneath grid member 20 thereby allowing the entire structure of depressor element 12 to be moved back upwards to its original position by the force of compressed spring 36. In this way the depressor elements can be pushed downwards manually to a selected depth, each depth individually adjusted to accommodate the object to be placed into cavity 16 as seen in FIG. 1. Each cavity can be formed of a single or plurality of depressor elements at either the same or different depth as desired by the user and also being dependent upon the shape of the object to be placed in the cavity. When reset lock screw 40 of each depressor element is rotated moving retainer clips 42 from their engagement with grid 20, it rotation causes the depressor element to rise back up to its initial height being the same height as the other undepressed depressor elements. This same structure is usable for the hexagonal members as seen in FIG. 10 where the grid extends through the member and each position retainer clip is held within a slot formed as part of the hexagonal depressor element. In the same fashion the triangular depressor elements also can be utilized with the position retainer clips held within slots as seen in FIG. 11 formed within the triangular depressor. It should be noted as mentioned above that other shapes of depressor elements can be utilized.

Figure 8:
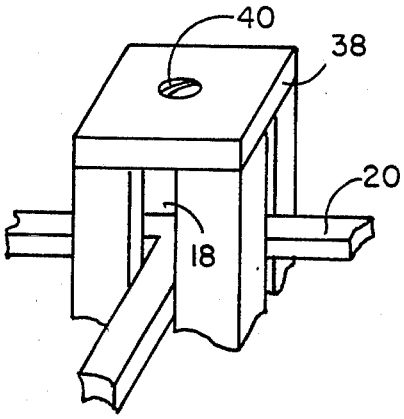
FIG. 8 illustrates a bottom view of a depressor element showing its release means.
Figure 9:
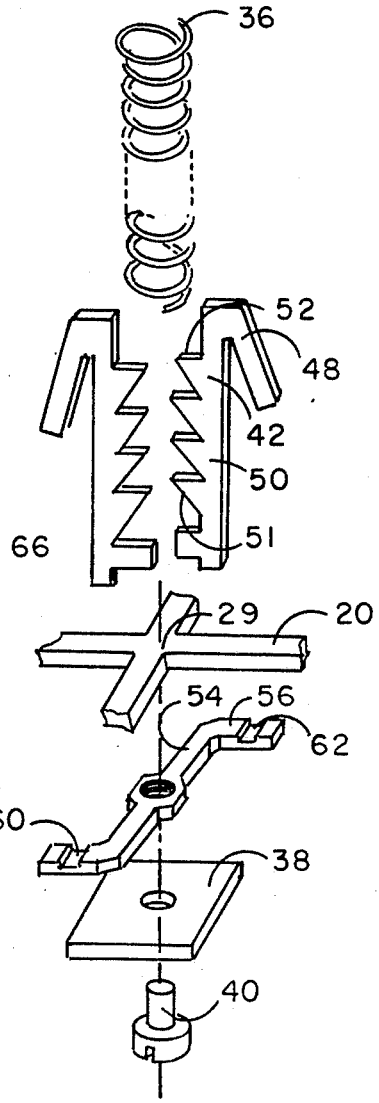
FIG. 9 illustrates an exploded cutaway expanded view of the parts within a depressor element showing its retention and release means.

FIG. 8 illustrates a bottom view showing retainer plate 38 and the bottom of reset lock screw 40. FIG. 9 is an exploded view of the internal mechanism of a depressor showing spring 36 and position retainer clips 42 above a section of grid 20. Beneath grid 20 is reset lock armature above retainer plate 38 and reset lock screw 40.

Although the present invention has been described with reference to particular embodiments, it will be apparent to those skilled in the art that variations and modifications can be substituted therefor without departing from the principles and spirit of the invention.

I claim:

1. A storage/display structure comprising:

a plurality of depressor elements arrayed in a group;

means for the depression of each of said depressor elements to form a cavity for receipt of an object to be displayed or stored;

means to retain each of said depressor elements in a selected lower mode at a selected depth;

means to release said depressor element to its original height when desired;

a plurality of slots defined in the sides of each of said depressor elements; and a grid adapted to receive a plurality of said depressor elements thereon with portions of said grid positioned within the slots of said depressor elements, said depressor elements adapted to move up and down on said grid.

2. The structure of claim 1 wherein the means to adjust the height of each of said depressor elements comprise release means adapted to releasably engage against said grid.

3. The structure of claim 2 wherein the tops of each of said depressor elements form a rectangular planar surface.

4. The structure of claim 2 wherein the tops of each of said depressor elements form a hexagonal planar surface.

5. The structure of claim 2 wherein the tops of each of said depressor elements form a triangular planar surface.

6. The structure of claim 2 wherein the means to retain each of said depressor elements to said grid comprises:

a compression spring disposed between the top of each of said depressor elements and said grid;

at least one position retainer clip having a plurality of teeth thereon with an arm to urge said position retainer clip from inside of said depressor element against said grid to engage and lock against it when in a lowered position as it is passed thereby; and release means comprised of a reset lock armature rotated by a lock screw engaged to the base of said position retainer clip which when said lock screw is rotated, moves said position retainer clip away from its engagement with said grid allowing said compression spring to raise said depressor element to its original height.

* * * * *